United States Patent [19]

Whitley, II

[11] Patent Number: 4,877,152

[45] Date of Patent: Oct. 31, 1989

[54] FUEL TANK VENT

[75] Inventor: Warwick M. Whitley, II, Panama City, Fla.

[73] Assignee: Attwood Corporation, Lowell, Mich.

[21] Appl. No.: 308,558

[22] Filed: Feb. 10, 1989

[51] Int. Cl.[4] ..... B65D 25/02; F16K 24/04

[52] U.S. Cl. ..... 220/374; 137/587; 220/DIG. 27; 440/88

[58] Field of Search ..... 114/211; 137/587-589; 220/202, 254, 255, 367, 372-374, DIG. 27; 440/88, 89; 280/5 A

[56] References Cited

U.S. PATENT DOCUMENTS

| | | | |
|---|---|---|---|
| 2,918,192 | 12/1959 | Dedman . | |
| 3,021,029 | 2/1962 | McKinlay . | |
| 3,072,284 | 1/1963 | Luhman, Jr. . | |
| 3,128,899 | 4/1964 | Runo | 220/374 |
| 3,866,789 | 2/1975 | Lambert | 220/373 |
| 3,916,724 | 11/1975 | Muller et al. | 137/589 |
| 4,184,603 | 1/1980 | Hamilton, Sr. | 220/254 |
| 4,353,318 | 10/1982 | Williams | 114/211 |
| 4,392,584 | 7/1983 | Bauer | 220/374 |
| 4,706,840 | 11/1987 | Thompson | 220/373 |
| 4,825,905 | 5/1989 | Whitley, II | 220/DIG. 27 |

OTHER PUBLICATIONS

Attwood Product Catalog 1987-1988, p. 45.
Gil Marine Catalog (undated), p. 29.
Perko Catalog, 1981, p. F-5.
Wilcox-Crittenden Catalog (undated), p. 26.

*Primary Examiner*—Jimmy G. Foster
*Attorney, Agent, or Firm*—Price, Heneveld, Cooper, DeWitt & Litton

[57] ABSTRACT

A fuel tank vent for venting air and fumes from a fuel tank of a boat, said vent including an outer and inner restraining means for restraining the flow of water and other foreign material from passing through said vent and contaminating the fuel in the tank. Each of said inner and outer restraining means include a unique structure in and of itself and in combination for causing said water and foreign material to take a tortuous path and to be trapped prior to reaching the fuel tank.

15 Claims, 2 Drawing Sheets

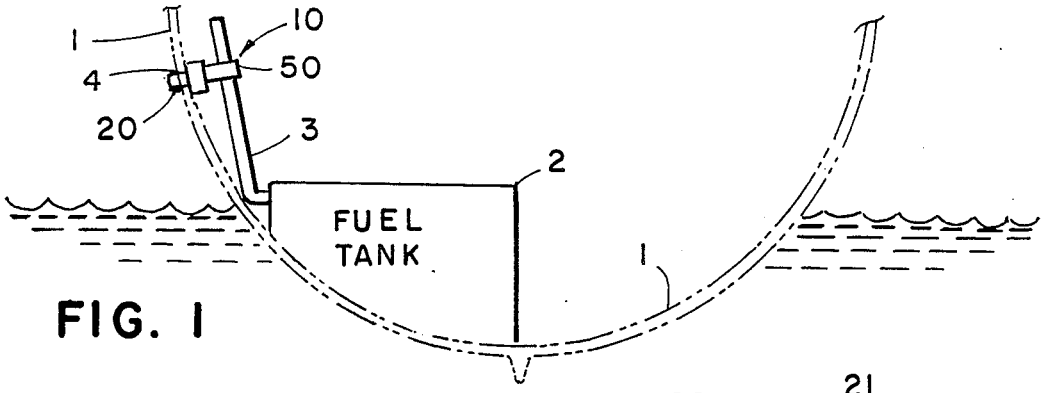
FIG. 1
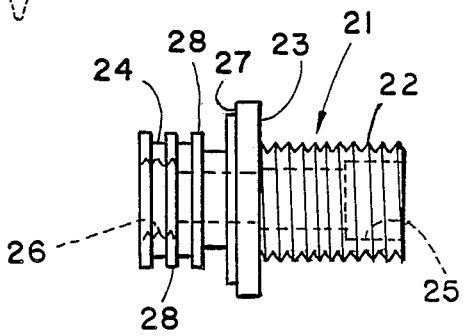
FIG. 5
FIG. 2
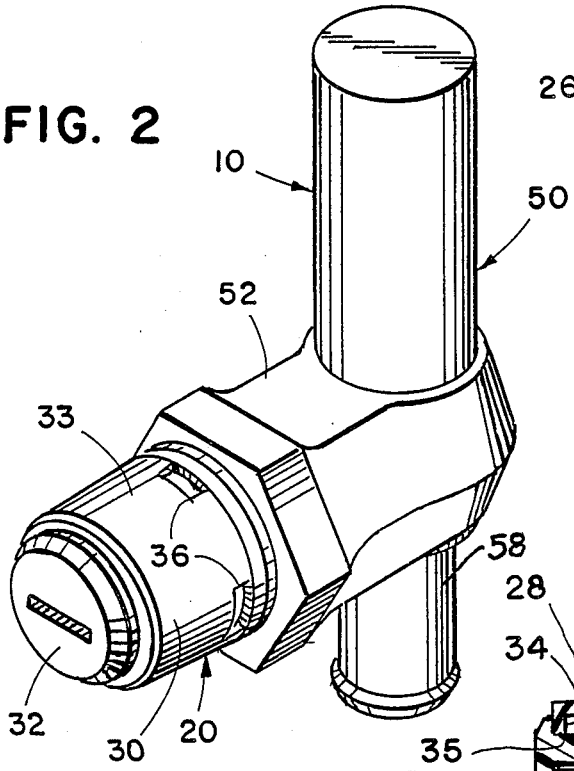
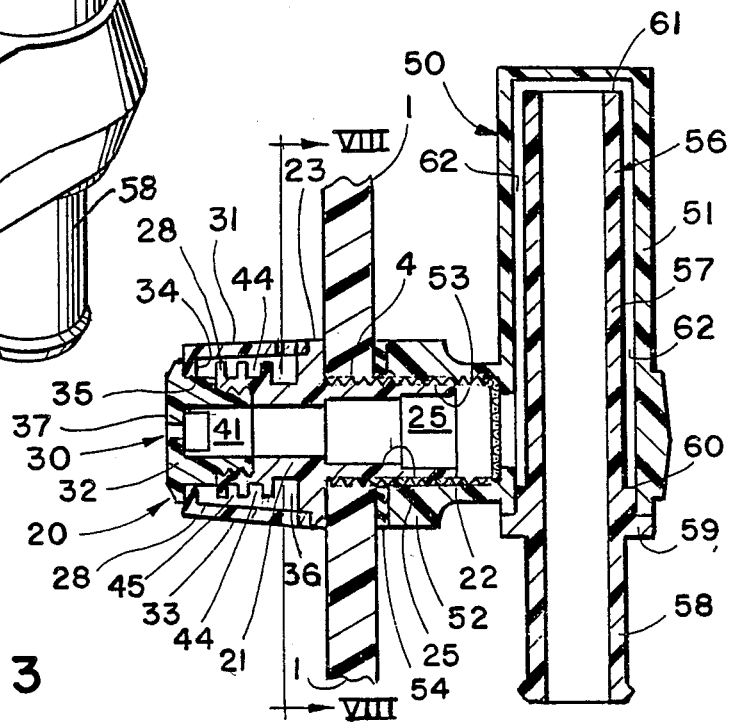
FIG. 3

FUEL TANK VENT

This invention relates to a fuel tank vent and particularly to such type of vent for fuel tanks on marine vessels in which the vent extends through the hull of a boat above the water line.

BACKGROUND OF THE INVENTION

Fuel tank vents are an absolute requirement for boats to allow air to escape as fuel is added to the tank and as the fuel is withdrawn while the engine is operating and to permit the fumes to escape from the tank. Such vents are located above the water line so as to prevent the water from flowing into the tank. However, because of the spray created by the boat as it passes through the water and because of waves splashing against the hull of the boat, it is necessary to prevent water from flowing through the fuel vent and thence to the hose connecting the vent to the tank. Water and other foreign material such as insects will contaminate the fuel in the tank and create damage to the boat's engine.

Since fuel vents are essential to the entire fuel system of the boat, extended efforts have been made to design and develop such vents which are splash resistant. To my knowledge no entirely satisfactory splash resistant vent has been designed.

The object of the present invention is to provide a fuel tank vent which is effective for venting the fuel tank of fumes and excess air as fuel is added to the tank. Such vent has a structure that effectively prevents water and other foreign materials, such as insects and the like, from passing through the vent and entering into the fuel tank.

SUMMARY OF THE INVENTION

The fuel tank vent of this invention provides a dual structure for restraining water and other foreign material from passing through the vent and into the fuel tank. The dual structure includes a restraining means located outside of the hull of the boat and communicating with a second restraining means located inside the hull. The outside restraining means includes an elongated member which extends through the wall of the hull of the boat and which includes a unique structure that provides a tortuous path for the flow of any water or other debris to pass therethrough.

The inner restraining means includes an elongated housing having an open lower end and a closed upper end forming a chamber communicating with the outer restraining means located outside of the hull. The housing is arranged at an angle to the elongated member of the inner restraining means. A vent tube, open at both ends, extends into the chamber a distance just short of the closed upper end. This vent tube is of a smaller outer cross section than the inner cross section of the housing. The vent tube has an end extending out of the chamber and a flange for closing the open end of the housing so that any water or other foreign material has to pass into the space between the outer wall of the tube and the inner wall of the housing, then upwardly to the open top end of the tube and downwardly through said tube in order to enter into the hose and the fuel tank.

As previously stated, the structure of the vent located outside of the hull is unique in and of itself. It includes an elongated member extending through the hull of the boat with an inner end adapted to be located inside the hull and the outer end adapted to be located outside the hull and having an opening extending thereto providing communication between the inner and outer ends thereof. Means is provided for securing the elongated member to the hull in the opening. A cover assembly is provided secured to the elongated member and having a side wall extending from the top to the base thereof and spaced from the elongated member to form a passageway for the flow of air from the top of the cover to the base of the cover. This cover assembly has first and second vent openings The first vent opening is located near the top of the cover assembly and the second vent opening is located in the side wall adjacent the base to provide communication through the passageway and the atmosphere outside the cover adjacent the base. Thus, the passage of air for communicating with the opening of the elongated member is confined through the passageway extending along the elongated member between the first vent opening and the second vent opening adjacent the base. Preferably radially extending spaced flanges are secured to the sides of the elongated member so as to provide an impediment against the flow of water or other foreign material through the passageway from the second vent opening to the first vent opening. In other words, the flow of any water or other foreign material is required to be along the axis and outside of the elongated member and the spaced radial flanges are located in this path to impede such flow.

Within a more specific preferred embodiment of this invention, the cover assembly is constructed of two pieces, a trim cover having a top with an opening therein which includes the wall extending from the top to the hull and a separate retainer member extending through the opening and securing the trim cover to the elongated member. This retainer member includes the first opening previously referred to.

The above objects, advantages and features of this invention will become more apparent from the following specification which decribes the invention in conjunction with the drawings.

BRIEF DESCRIPTION OF THE DRAWINGS

FIG. 1 is a partial, elevational, cross-sectional sketch of the hull of a boat illustrating the position of the fuel tank vent on the boat in relation to the hull and the fuel tank;

FIG. 2 is a front, elevational, perspective view of the fuel tank vent of this invention;

FIG. 3 is a cross-sectional, elevational view of the vent of this invention mounted on the hull of a boat

FIG. 5 is a side, elevational view of the vent body which is one component of the vent of this invention;

DESCRIPTION OF THE PREFERRED EMBODIMENT

Figures 4, 6, 7, 8:
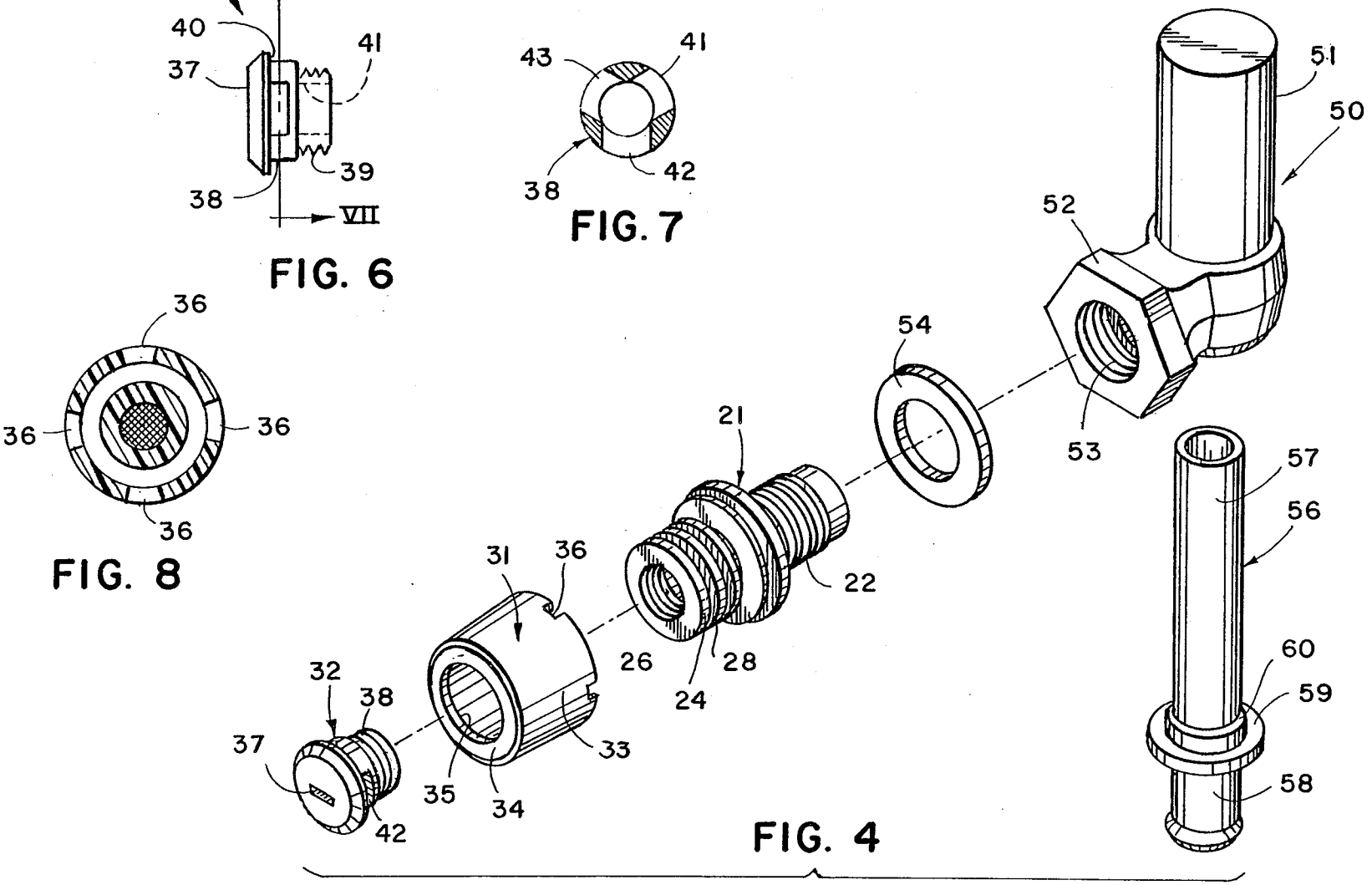
FIG. 4 is an exploded, perspective view disclosing the various parts of the vent of this invention.
FIG. 6 is a side, elevational view of the trim cover retainer which is another component of the vent of this invention.
FIG. 7 is a cross-sectional view taken along the plane VII—VII of FIG. 6.
FIG. 8 is a cross-sectional view taken along the plane VIII—VIII of FIG. 3.

Referring now specifically to the drawings, FIG. 1 discloses the hull 1 of a boat with a fuel tank 2 mounted therein. The fuel tank vent 10 is disclosed mounted through the hull 1 of the boat and connected to a hose 3 leading to the fuel tank 2.

The gas tank vent includes the outer restraining means 20 and the inner restraining means 50 both provided to restrain the flow of water and other foreign material through the vent and into the hose 4 leading into the fuel tank 2.

The outer restraining means 20 includes the elongated vent body 21 (FIGS. 3, 4 and 5) extending through the opening 4 of the hull 1 (FIG. 3). The vent body 21 includes an inner threaded end 22 extending through the hull opening 4 and terminating at a shoulder of flange 23 that abuts against the outside of the hull 1. An outer end 24 extends outwardly from the flange 23. It includes a plurality of radial flanges 28 provided for the purpose of impeding the flow of water and other foreign material, as will be explained hereinafter. A passageway or opening 25 extends through the vent body 21 and the outer end 24 is threaded at 26 for the purpose of receiving a trim cover retainer 32 which will be described hereinafter.

The outer restraining means 20 also includes the trim cover assembly 30 comprising the trim cover 31 and the trim cover retainer 32. Trim cover 31 includes the side portions 33 and the top portion 34 which has a circular opening 35. The sides 33 from the top to the base are slanted outwardly to provide a truncated shaped cover. The base of the side portions fit into a circular recess 27. At this base, the trim cover 31 has a plurality of vent openings 36 provided for the purpose as will be set forth hereinafter.

The trim cover retainer (FIGS. 3, 6 and 7) includes a cover portion 37 of larger diameter than the opening 35. A cylindrical tube like protrusion 38 extends from cover portion 37. Protrusion 38 protrudes through the opening 35. Protruding from the protrusion 38 is the threaded end portion 39 which is threaded into the threads 26 of the vent body 21 so as to draw the shoulder 40 against the top portion 34 of the trim cover 31. As disclosed in FIG. 7, a central opening 41 extends through protrusions 38 and 39 and a major portion of the protusion 38 includes the openings 42, 43 and 44 to provide a vent substantially around the entire circumference of the protrusion 38. As a result, substantially the entire passageway formed between the wall of the trim cover 31 and the elongated vent body 21 is in direct communication with the central opening 25 of the elongated vent body 21.

The inner restraining means 50 includes the vent tube housing 51 interconnected to the inner threaded end 22 of the elongated vent body 21 by the connector member 52 which includes the threaded bore 53 receiving the threads of the inner end 22 of vent body 21. The connector 52 is hexagonal in shape for the purpose of receiving a wrench for turning the entire inner restraining means 50 on the threads of the inner end 22. As disclosed, a rubber washer 54 is located between the hull 1 and the connecting member 52 for providing a tight seal.

It is important that the vent tube housing 51 has sufficient length as indicated to receive a vent tube 56 which has the two ends 57 and 58 with a flange 59 and collar 60 therebetween. As disclosed in FIG. 3, the collar 60 is of the same diameter as the inner diameter of the housing 51 and the flange 59 is of greater so as to provide a shoulder which closes the lower end of housing 51 and locates or determines the position of the extreme end 61 of the vent tube 56. It will be noted that the vent tube 56 is of smaller outside diameter than the inside diameter of the vent tube housing 51. This provides a space 62 between the outer surface of the vent tube and the inner surface of the vent tube housing so that the air and fumes vented from the fuel tank pass upwardly into the vent tube around the top thereof and through the space 62 which is in communication with the bore 53 of the elongated vent body 21. Thus, inner restraining means 50 provides a tortuous path for any water or other foreign material passing through the inner restraining means.

OPERATION

Having described the details of the various components of this fuel tank vent. The operation of the same should be quite evident. As previously stated, the air and fumes escape through the inside of the vent tube around the top 61, through the space 62 between the vent tube 56 and the vent tube housing 51, then through the passageway 25 of the vent body 21, central opening 41 of trim cover retainer, out of the openings 42, 43 and 44 of the trim cover retainer 32, through the passageway 45 formed between the wall 31 of the trim cover and the vent body 21 and then out of the openings 36 at the base of the trim cover.

By the same token, any water splashed against the outer restraining means 20 is required to pass through the openings 36 in the base of the trim cover 31, through the passageway 45, through the openings 42, 43 and 44 into the central opening 41. In passing through the passageway 45, the radial flanges 28 serve as an impediment to the flow of any moisture through the passageway 45. From the openingss 42, 43, 44 and central opening 41, any moisture or other foreign material must then pass through the opening or passageway 25 of the vent body 21, through the screen 25, upwardly through the space 62 and around the top end 61 of the vent tube 57. Thus to reach the fuel tan hose 3 and the fuel tank, the water and other foreign material have to follow such a tortuous path that substantially no water, moisture or other foreign material reaches the fuel tank 2.

The stucture of this vent makes for easy installation and for disassembling for clean out. Further, if the water should ever reach the space 62 between vent tube 57 and vent tube housing 51, only under extreme circumstances would the water accumulate to a height in space 62 that would cause the water to flow over the top end 61 of the vent tube. Instead, the water would flow downwardly through the same path from whence it came.

It should be understood that although I have disclosed a preferred embodiment of my invention, other embodiments and modifications can be made without departing from the spirit of this invention. Therefore, the scope of this invention should be interpreted only as set forth in the appended claims.

An exclusive property or privilege is claimed as defined as follows.

1. In a fuel tank for a marine vessel in which an elongated member is provided to extend through an opening in the hull of said vessel; said elongated member having an inner end adapted to be located inside said hull and an outer end adapted to be located outside said hull and an opening extending therethrough providing communication between the inner and outer ends of said elongated member with means for securing said elongated member to said hull in said opening the improvement comprising:

an elongated housing adapted to be located inside said hull and having an open lower end and a closed upper end and a chamber communicating with said opening in said elongated member;

said housing being arranged at an angle to said elongated member; and a vent tube open at both of its ends extending into said chamber short of said closed upper end and of a smaller outer cross section than the inner cross section of said housing to provide a space therebetween; said vent tube having an end extending out of said chamber for connection to a hose leading to a fuel tank; and means at the lower end of said housing for closing said space between said tube and housing whereby air and fumes vented from said tank are required to pass upwardly through said tube and then downwardly through said space and into the opening of said elongated member.

2. The fuel tank vent of claim 1 in which an attachment member extends from said tubular housing orthogonal to the axis of said housing for securing said tubular housing to said elongated member; and an opening is provided extending through said attachment member providing communication between said opening in said elongated member and the said space inside of said tubular housing.

3. The fuel tank vent of claim 1 in which a flange of greater cross section than the open end of said housing is provided on the exterior of said tube and secured to said open end to locate said tube short of the closed end of said housing.

4. The fuel vent of claim 1 in which the said housing is tubular and the tube is cylindrical and of slightly smaller diameter than the tubular housing.

5. In a fuel tank for a marine vessel in which an elongated member is provided to extend through an opening in the hull of said vessel; said elongated member having an inner end adapted to be located inside said hull and an outer end adapted to b located outside said hull and an opening extending therethrough providing communication between the inner and outer ends of said elongated member with means for securing said elongated member to said hull in said opening the improvement comprising a cover assembly having a top secured to said elongated member and having a side wall extending from said top to the base thereon and spaced from said elongated member to form a passageway for the flow of air from the said top to said base; said cover assembly having a first vent opening means inside the side walls near the top of said cover assembly to provide communication with the vent opening through said elongated member and said passageway; and a second vent opening means located in said side wall adjacent the base thereof to provide communication with said passageway and the atmosphere outside said cover only adjacent said base whereby the passage of air for communication with the said opening of said elongated member is confined through said passageway extending along said elongated member between said first vent opening near said top to said second vent opening adjacent said base.

6. The tank vent of claim 5 in which radially extending flange means is secured to the outer sides of said elongated member.

7. The tank vent of claim 5 in which a housing is provided on the inner end of said elongated member, said housing having an open lower end and a closed upper end and a chamber communicating with said opening in said elongated member;

said housing being arranged at an angle to said elongated member; and a vent tube open at both of its ends extending into said chamber short of said closed upper end and of a smaller outer cross section than the inner cross section of said housing, said vent tube having an end extending out of said chamber for connection to a hose leading to a fuel tank; and means for closing the space between tube and housing at the lower end of said housing.

8. The fuel tank vent of claim 7 in which an attachment member extends from said tubular housing orthogonal to the axis of said housing for securing said tubular housing to said elongated member; and an opening is provided extending through said attachment member providing communication between said opening in said elongated member and the inside of said tubular housing.

9. The fuel tank vent of claim 7 in which a flange of greater cross section than the open end of said housing is provided on the exterior of said tube and secured to said open end to locate said tube short of the closed end of said housing.

10. The fuel vent of claim 7 in which the said housing is tubular and the tube is cylindrical and of slightly smaller diameter than the tubular housing.

11. In a fuel tank for a marine vessel in which an elongated member is provided to extend through an opening in the hull of said vessel; said elongated member having an inner end adapted to be located inside said hull and an outer end adapted to be located outside said hull and an opening extending therethrough providing communication between the inner and outer ends of said elongated member;

means for securing said elongated member to said hull in said opening in said hull, the improvement comprising:

a cover assembly including a trim cover having a top with an opening therein and a wall extending from said top substantially to said hull;

a separate retainer member extending through said opening, said retainer member having at one end a closure means for closing the said opening in said trim cover and at the other end a securing means for removably securing said retainer member to the outer end of said elongated member;

vent openings in said retainer member between said closure means and securing means; and vent openings in the wall of said trim cover adjacent said hull.

12. The tank vent of claim 5 in which the trim cover of said cover assembly has an opening in the top thereof;

a separate retainer member extending through said opening, said retainer member having at one end a closure means for closing the said opening in said trim cover and at the other end a securing means for removably securing said retainer member to the outer end of said elongated member;

said first vent opening being located in said retainer member between said closure means and securing means; and said second vent opening means being located in the wall of said trim cover adjacent said hull.

13. The tank vent of claim 11 in which radially extending flange means is secured to the sides of said elongated member.

14. The tank vent of claim 12 in which radially extending flange means is secured to the sides of said elongated member.

15. The tank vent of claim 12 in which a housing is provided on the inner end of said elongated member, said housing having an open lower end and a closed upper end and a chamber communicating with said opening in said elongated member;

said housing being arranged at an angle to said elongated member; and a vent tube open at both of its ends extending into said chamber short of said closed upper end and of a smaller outer cross section than the inner cross section of said housing, said vent tube having an end extending out of said chamber for connection to a hose leading to a fuel tank; and means for closing the space between tube and housing at the lower end of said housing.

* * * * *